US005989133A

United States Patent [19]

Lee et al.

[11] Patent Number: 5,989,133

[45] **Date of Patent: *Nov. 23, 1999**

[54] GOLF CLUB AND SHAFT THEREFOR AND METHOD OF MAKING SAME

[75] Inventors: Gary L. Lee, Tupelo; Edwin B. Finley, Amory; Larry W. Howell, Amory; Curtis W. Lewellen, Amory, all of Miss.

[73] Assignee: True Temper Sports, Inc., Memphis, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/642,363

[22] Filed: May 3, 1996

[51] Int. Cl.[6] ..... A63B 53/12

[52] U.S. Cl. ..... 473/323; 72/283

[58] Field of Search ..... 473/316, 317, 473/318, 319, 320, 321, 322, 287, 289; 72/274, 276, 283

[56] References Cited

U.S. PATENT DOCUMENTS

| | | | |
|---|---|---|---|
| 976,267 | 11/1910 | Knight | 473/316 |
| 1,564,208 | 12/1925 | Connolly | 473/316 |
| 1,653,428 | 12/1927 | Brinkman | 473/316 |
| 1,974,389 | 9/1934 | Cowdery | 473/323 |
| 2,066,962 | 1/1937 | Cross | 473/323 |
| 2,095,563 | 10/1937 | Cowdery | 72/276 |
| 2,250,428 | 7/1941 | Vickery | 473/289 |
| 2,258,242 | 10/1941 | Ditzel et al. | 72/276 |
| 2,679,925 | 6/1954 | McIlvried et al. | 72/276 |
| 3,083,969 | 4/1963 | Bills | 473/321 |
| 3,809,403 | 5/1974 | Hunter | 473/316 |
| 4,122,593 | 10/1978 | Braly | 473/289 |
| 4,165,874 | 8/1979 | Lezatte | 473/323 |
| 4,169,595 | 10/1979 | Kaugars | 473/323 |
| 4,288,075 | 9/1981 | Kaugars | 473/323 |
| 4,313,328 | 2/1982 | Janssen | 72/276 |
| 4,606,212 | 8/1986 | Sunaga | 72/283 |
| 4,616,500 | 10/1986 | Alexoff | 72/283 |
| 4,726,211 | 2/1988 | Sunaga | 72/283 |
| 4,788,841 | 12/1988 | Calhoun et al. | 72/283 |
| 4,961,576 | 10/1990 | Meredith | 473/323 |
| 5,018,735 | 5/1991 | Meredith | 473/318 |
| 5,074,555 | 12/1991 | Meredith | 473/323 |
| 5,265,872 | 11/1993 | Tennent | 473/320 |
| 5,573,468 | 11/1996 | Baumann | 473/321 |

*Primary Examiner*—Jeanette Chapman
*Assistant Examiner*—Stephen L. Blau
*Attorney, Agent, or Firm*—Harness, Dickey & Pierce, P.L.C.

[57] ABSTRACT

A golf club 20 includes a shaft 22 having a club head 32 secured to a tip end section 24 thereof and a grip 34 secured to a butt end section 26 thereof. A central section 28 of the shaft 22 is formed with a plurality of segments 44 which are of successively smaller diameters between the butt end section 26 and the tip end section 24. The wall of the tip end section 24 has portions which are of a prescribed thickness. The wall of the butt end section 26 has portions which are of a thickness less than the prescribed thickness. The wall of the central section 28 has portions which are of a thickness less than the thickness of the portion of the wall of the butt end section 26.

14 Claims, 8 Drawing Sheets

GOLF CLUB AND SHAFT THEREFOR AND METHOD OF MAKING SAME

BACKGROUND OF THE INVENTION

This invention relates to a golf club, to a shaft used therewith and to a method of making the shaft. This invention particularly relates to a golf club, a shaft therefor which is structured in a butt end section, a central section and a tip end section thereof to enhance the playability of the club from the standpoint of stresses and flexure profile. This invention also particularly relates to a method of making the shaft.

A golf club includes a shaft having a tip end section and a butt end section with a club head mounted on the end of the tip end section and a hand grip mounted on the butt end section. The shaft is further formed with a central section which extends between inboard ends of the butt end section and the tip end section.

The shaft is a critical part of the club and the structural characteristics of the shaft play an important role in the results obtained by a golfer in the playing of the game of golf. Shafts for golf clubs are typically made from a composite non-metallic material or a metal such as, for example, steel.

In one technique of making steel or metal shafts, a round tube having a uniform thickness from one end to the other is processed through a taper press, in a die sink process, to form a generally cylindrical butt end section, a tapered tip end section and a stepped configuration in a central section of the shaft between the butt and tip end sections. Shafts of this type typically have a specified thickness at the outboard end of the tip end section with prescribed decreases in the thicknesses to the outboard end of the butt end section thereof. Thus, the heaviest portion of the shaft is located in the tip end section, where the wall thickness is the greatest, and the lightest portion in the butt end section where the wall thickness is the smallest.

This results in a golf club shaft having stresses which are significantly high in the butt end section, or grip, when the club is used in the playing the game of golf. The resultant placement of these stresses could have a deleterious effect on the golfer's playing of the game. In addition, the resultant moment per flexural rigidity of such a shaft, and the club formed thereby, is significantly high at a point along the shaft generally in the area of the butt end section, or grip, of the club. This results in a flexure profile wherein the location of the initial flexure point of the shaft, and the club, is in the area of the butt end section, or grip. When a golfer uses a golf club of this type, the club head is at such an angle upon impact with the ball that the optimum launch angle of the ball may not be attainable.

Consequently, there is a need for a shaft, and a golf club, which locates the stresses away from the grip during the swinging of the club and upon impact with the ball. Further, there is a need for a shaft, and a golf club, having a flexure profile which provides the golfer with a facility for obtaining improved distance of travel for the ball when impacted by the club head.

SUMMARY OF THE INVENTION

In view of the foregoing needs, it is an object of this invention to provide a golf club, and shaft, which has structure to facilitate the location of major stresses imposed on the club and the shaft upon impact with a ball to an area other than a butt end section or grip of the club.

Another object of this invention is to provide a golf club, and shaft, which has a flexure profile with a flexure point located in an area other than a butt end section or grip of the club.

Still another object of this invention is to provide an efficient process of making a golf club and shaft: which locates stresses occurring upon impact with a ball, and has a flexure point at a location, in an area other than a butt section or grip of the club.

With these and other objects in mind, this invention contemplates a golf club having a shaft formed along an axis thereof wherein a first end section of the shaft has at least a portion thereof formed with a prescribed thickness. A second end section of the shaft is spaced axially from the first end section and has at least a portion thereof formed with a second-section thickness which is less than the prescribed thickness. A third section of the shaft is formed axially thereof between the first end section and the second end section and has at least a portion thereof formed with a third-section thickness which is less than the second-section thickness.

This invention further contemplates a shaft having a longitudinal axis wherein a first end section of the shaft has at least a portion thereof formed with a prescribed thickness. A second end section of the shaft is spaced axially from the first end section and has at least a portion thereof formed with a second-section thickness which is less than the prescribed thickness. A third section of the shaft is formed axially thereof between the first end section and the second end section and has at least a portion thereof formed with a third-section thickness which is less than the second-section thickness.

This invention also contemplates a method of making a shaft by first making a straight tube having a symmetrically round exterior surface and a linear axis. A first end section of the tube is formed with a wall of a first prescribed thickness. A second end section of the tube is formed with a wall having a second-section thickness which is less than the first prescribed thickness and is spaced axially from the first end section. A central section is located axially between the first and second end sections and is formed with a wall having a thickness which is less than the second-section thickness. The straight tube is then processed through a taper press in a die sink operation to form a shaft having a first end section, at least a portion of which is formed with a second prescribed thickness which is greater than the first prescribed section. The shaft is further formed with a second end section axially spaced from the first end section of the shaft with at least a portion thereof being formed with a wall at a thickness less than the first prescribed thickness. The shaft is also formed with a central section located between the first and second sections of the shaft, a portion of which is formed with a wall having a thickness less than the thickness of the second end section of the shaft.

Other objects, features and advantages of the present invention will become more fully apparent from the following detailed description of the preferred embodiment, the appended claims and the accompanying drawings.

DESCRIPTION OF THE PREFERRED EMBODIMENT

Figure 1:
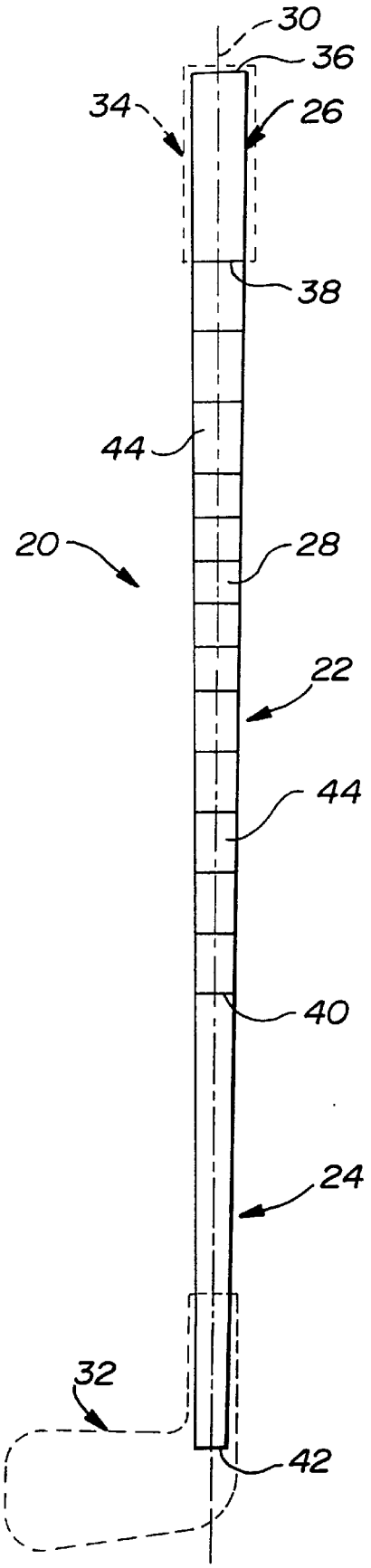
FIG. 1 is a side view showing a golf club including a shaft having a grip secured to a butt end section of the shaft and a club head secured to a tip end section of the shaft embodying certain principles of the invention.

Referring to FIG. 1, a golf club 20 includes a shaft 22 having a tip end section 24, a butt end section 26 and a central section 28 joined between the tip end section and the butt end section, all aligned along an axis 30 of the shaft. A club head 32, shown in phantom, is secured to the tip end section 24 of the shaft 22 and a grip 34, shown in phantom, is secured to the butt end section 26 of the shaft. The butt end section 26 is generally cylindrical from an out board end 36 to an inboard end 38 thereof. The tip end section 24 is tapered inward from an inboard end 40 to an outboard end 42 thereof.

The central section 28 is formed with a series of generally cylindrical segments 44. The segment 44 which is joined to the inboard end 38 of the butt end section 26 is formed with a prescribed inner diameter and a prescribed outer diameter. The remaining segments 44 are of successively smaller diameters with the segment of smallest diameters joined with the inboard end 40 of the tip end section 24.

In the preferred embodiment, the shaft is composed of steel. However, other materials such as, for example, titanium could be used without departing from the spirit and scope of the invention.

Figure 2:
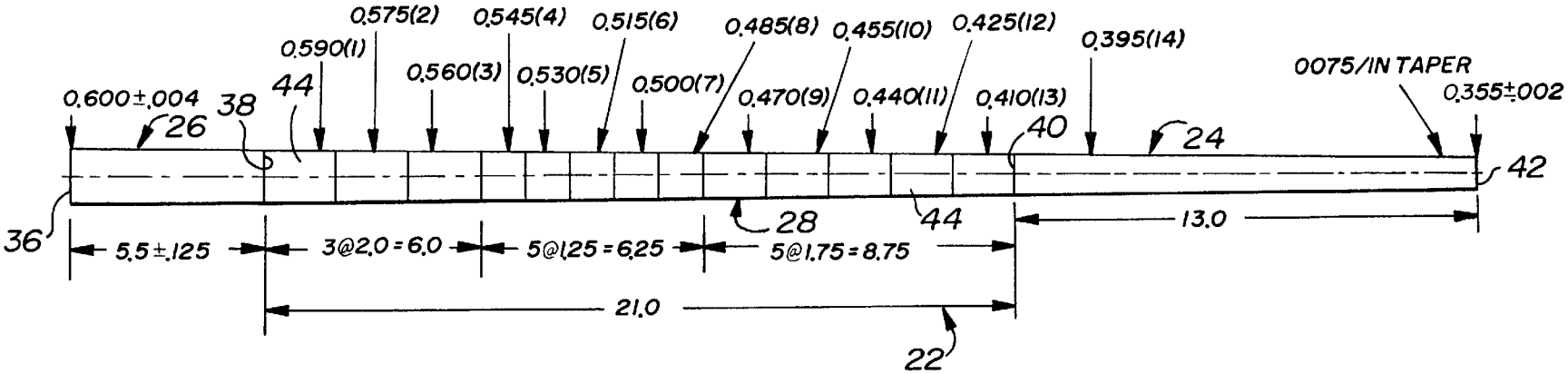
FIG. 2 is a side view showing a golf club shaft embodying certain principles of the invention.

Referring to FIG. 2, various length and diameter dimensions are illustrated for the shaft 22 which has an overall length of 39.5 inches. The shaft 22 weighs approximately 4.062 ounces with a shaft balance point located 19.8 inches from the outboard end 36 of the butt end section 26. The length dimensions for the segments 44 are illustrated in groups. For example, the three segments 44 which are closest to the butt end section 26 are each 2.0 inches in length for a total of 6.0 inches. The external diameters of these three segments 44 are illustrated above each respective segment.

While the shaft 22 illustrated in FIG. 2 is 39.5 inches in length with a prescribed weight and balance point, and represents the preferred embodiment herein, it is to be understood that shafts of other dimensions, weights and balance points could be manufactured to attain the attributes of the preferred embodiment without departing from the spirit and scope of the invention.

Figure 3:
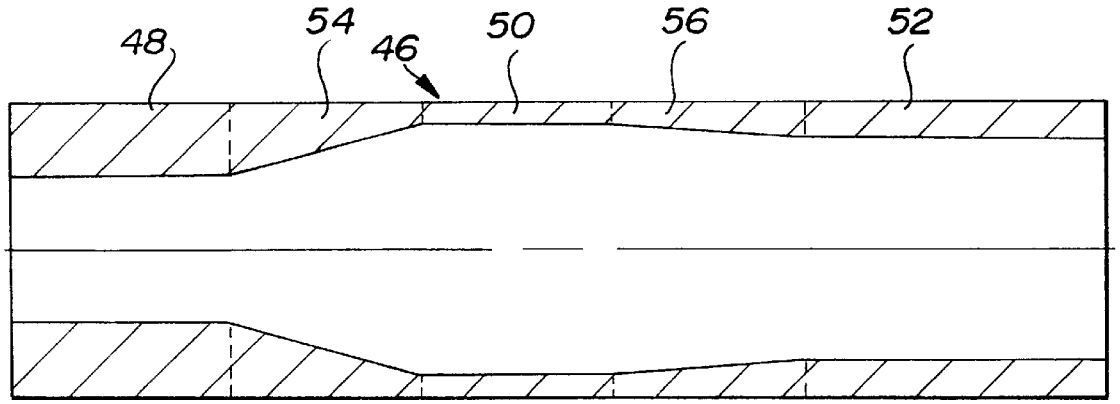
FIG. 3 is a sectional view showing a cylindrical tube having a uniformly smooth exterior surface and three axially spaced sections of three different uniform wall thicknesses with two transition sections joining the three spaced sections, all in accordance with certain principles of the invention.

In the manufacture of the preferred embodiment of the shaft 22, a tube blank 46 as shown in FIG. 3 is formed with three spaced uniform sections 48, 50 and 52 which are linked or joined by two transition sections 54 and 56. The tube blank 46 is formed with a uniform external diameter of 0.600 inch from one end to the other. The length of the tube blank 46 is 37.75 inches and the lengths, in inches, of the sections 48, 50, 52, 54 and 56 are 6.0, 6.0, 11.75, 6.0 and 8.0, respectively. The thickness of the wall of section 48 is 0.037 inch, the thickness of the wall of section 50 is 0.0117 inch and the thickness of the wall of section 52 is 0.0157 inch. The wall thicknesses of the transitional sections 54 and 56 each vary as the sections extend the sections 48, 50 and 52. The weight of the tube 46 blank is 4.187 ounces.

Figure 4:
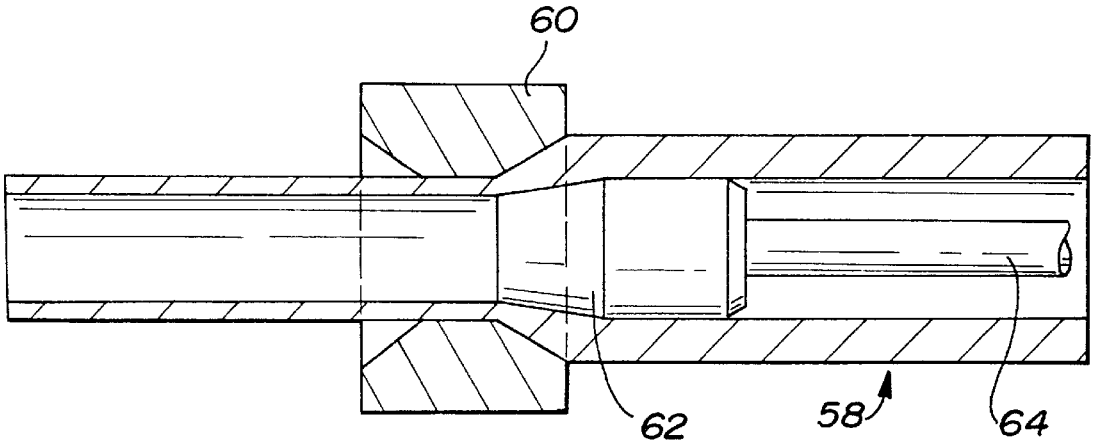
FIG. 4 is a sectional view of showing an apparatus for and a method of making the tube of FIG. 3 in accordance with certain principles of the invention.

Referring to FIG. 4, the tube blank 46 is formed on a drawbench whereby a cylindrical tube 58 of a prescribed uniform outside diameter of 0.650 inch and a uniform wall thickness of 0.17 inch is drawn or pulled through a die 60 to reduce the tube 58 to the outside diameter of the tube blank 46, i.e., 0.600 inch. A nib 62 is mounted on an end of a rod 64 and is inserted into a trailing end of the tube 58. The nib 62 is positioned adjacent the location of the die 60 and is periodically and selectively moved axially into and out of the plane of the forming mouth of the die to shape the interior of the tube 58 in the formation of the interior walls of the sections 48, 50, 52, 54 and 56 as shown in FIG. 3 and as described above. It is noted that a single tube 58 of considerable length can be passed through the drawbench to form successive tube blanks 46 which remain joined. Thereafter, the tube 58 is cut into desired lengths, i.e., 37.75 inches to form the tube blanks 46.

Figure 5:
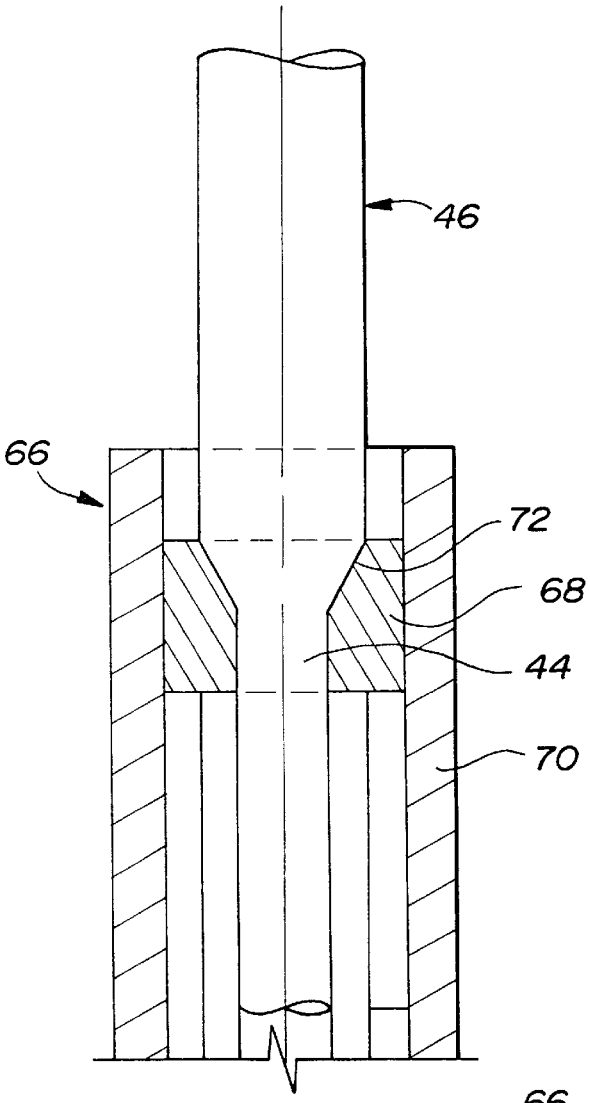
FIG. 5 is a sectional view showing a taper press used in the making of the shaft of FIG. 2 embodying certain principles of the invention.
Figure 6:
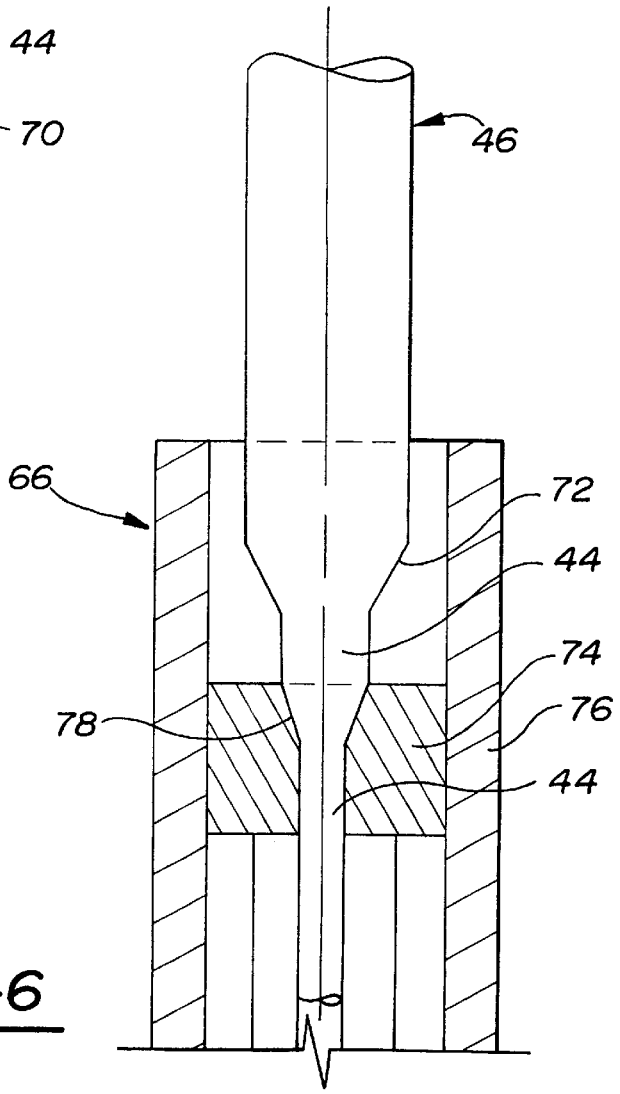
FIG. 6 is a graph illustrating the stresses occurring along a conventional steel shaft having stepped formations similar to the stepped formations of the shaft of FIG. 2.

Referring to FIGS. 5 and 6, the tube blank 46 is then pushed into a step taper press 66 and processed through a die sink operation to form the stepped segments 44. In particular, as shown in FIG. 5, the press 66 includes a die 68 at a first station which is precisely located within a die holder 70. The tube blank 46 is pushed into the die 68 a prescribed distance to form a first transitional surface 72 from the inboard end 38 of the butt end section 26 and to form the segment 44 of the largest diameter as shown in FIG. 2. The tube blank 46 is then withdrawn from the die 68 and moved to a second station, shown in FIG. 6, which includes a die 74 located precisely within a die holder 76. The die has a smaller forming passage than the die 68 and facilitates the forming of a second transition surface 78 and the segment 44 having the second largest diameter shown in FIG. 2. This process is continued until all segments 44 and interconnecting transition surfaces have been formed as shown in FIG. 2. Thereafter, the tip end section 24 is swaged to form the taper as indicated in FIG. 2.

During the various forming stages in the manufacture of the shaft 22, the exterior surface of the shaft is formed with the dimensions as shown in FIG. 2. Also, the interior surface is formed in such a manner that the wall thickness from the outboard end 36 of the butt end section 26 to the outboard end of the tip end section 42 varies considerably. In particular, as shown in Table I on page 8, the diameter "D" in inches and the thickness "t" in inches is tabulated at indicated distances "L" in inches from the outboard end 42 of the tip end section 24. For comparison, Table II reveals similar parameters for a conventional shaft which was manufactured from a tube blank different from tube blank 46 and not formed with the three sections 48, 50 and 52, and the transitional sections 54 and 56 thereof. Table I reveals that the shaft 22 has a wall thickness at the outboard end 42 of the tip end section 24 of 0.024 inch. The wall thickness decreases as the shaft 22 extends toward the middle thereof and eventually has a wall thickness of 0.0125 inch at a distance of 26.751 inch from the outboard end 42 of the tip end section 24. The wall thickness then

TABLE I

| L, in | D, in | t, in |
|---|---|---|
| 0 | 0.355 | 0.024 |
| 1 | 0.3625 | 0.023 |
| 2 | 0.37 | 0.023 |
| 3 | 0.3775 | 0.023 |
| 4 | 0.385 | 0.022 |
| 5 | 0.3925 | 0.021 |
| 6 | 0.395 | 0.02 |
| 7 | 0.395 | 0.0195 |
| 8 | 0.395 | 0.0195 |
| 9 | 0.395 | 0.0195 |
| 10 | 0.395 | 0.019 |
| 11 | 0.395 | 0.0185 |
| 12 | 0.395 | 0.018 |
| 13 | 0.395 | 0.0175 |
| 13.001 | 0.41 | 0.0175 |
| 14 | 0.41 | 0.017 |
| 14.75 | 0.41 | 0.0165 |
| 14.751 | 0.425 | 0.015 |
| 15 | 0.425 | 0.015 |
| 16 | 0.425 | 0.015 |
| 16.5 | 0.425 | 0.015 |
| 16.501 | 0.44 | 0.014 |
| 17 | 0.44 | 0.014 |
| 18 | 0.44 | 0.014 |
| 18.25 | 0.44 | 0.014 |
| 18.251 | 0.455 | 0.014 |
| 19 | 0.455 | 0.014 |
| 20 | 0.455 | 0.014 |
| 20.001 | 0.47 | 0.0135 |
| 21 | 0.47 | 0.0135 |
| 21.75 | 0.47 | 0.0135 |
| 21.751 | 0.485 | 0.0135 |
| 22 | 0.485 | 0.0135 |
| 23 | 0.485 | 0.0135 |
| 23.001 | 0.5 | 0.013 |
| 24 | 0.5 | 0.013 |
| 24.25 | 0.5 | 0.013 |
| 24.251 | 0.515 | 0.013 |
| 25 | 0.515 | 0.013 |
| 25.5 | 0.515 | 0.013 |
| 25.501 | 0.53 | 0.013 |
| 26 | 0.53 | 0.013 |
| 26.75 | 0.53 | 0.013 |
| 26.751 | 0.545 | 0.0125 |
| 27 | 0.545 | 0.0125 |
| 28 | 0.545 | 0.0125 |
| 28.001 | 0.56 | 0.013 |
| 29 | 0.56 | 0.013 |
| 30 | 0.56 | 0.013 |
| 30.001 | 0.575 | 0.0135 |
| 31 | 0.575 | 0.0135 |
| 32 | 0.575 | 0.0135 |
| 32.001 | 0.59 | 0.014 |
| 33 | 0.59 | 0.014 |
| 34 | 0.59 | 0.014 |
| 34.001 | 0.6 | 0.014 |
| 35 | 0.6 | 0.014 |
| 36 | 0.6 | 0.014 |
| 37 | 0.6 | 0.014 |
| 38 | 0.6 | 0.014 |
| 39 | 0.6 | 0.014 |
| 39.5 | 0.6 | 0.014 |

TABLE II

| L, in | D, in | t, in |
|---|---|---|
| 0 | 0.355 | 0.023 |
| 1 | 0.3625 | 0.022 |
| 2 | 0.37 | 0.021 |
| 3 | 0.3775 | 0.022 |
| 4 | 0.385 | 0.021 |
| 5 | 0.3925 | 0.02 |
| 6 | 0.395 | 0.0195 |
| 7 | 0.395 | 0.0195 |
| 8 | 0.395 | 0.0185 |
| 9 | 0.395 | 0.018 |
| 10 | 0.395 | 0.017 |
| 11 | 0.395 | 0.016 |
| 12 | 0.395 | 0.0155 |
| 13 | 0.395 | 0.015 |
| 13.001 | 0.41 | 0.015 |
| 14 | 0.41 | 0.015 |
| 14.75 | 0.41 | 0.015 |
| 14.751 | 0.425 | 0.0145 |
| 15 | 0.425 | 0.0145 |
| 16 | 0.425 | 0.0145 |
| 16.5 | 0.425 | 0.0145 |
| 16.501 | 0.44 | 0.014 |
| 17 | 0.44 | 0.014 |
| 18 | 0.44 | 0.014 |
| 18.25 | 0.44 | 0.014 |
| 18.251 | 0.455 | 0.014 |
| 19 | 0.455 | 0.014 |
| 20 | 0.455 | 0.014 |
| 20.001 | 0.47 | 0.0135 |
| 21 | 0.47 | 0.0135 |
| 21.75 | 0.47 | 0.0135 |
| 21.751 | 0.485 | 0.0135 |
| 22 | 0.485 | 0.0135 |
| 23 | 0.485 | 0.0135 |
| 23.001 | 0.5 | 0.0135 |
| 24 | 0.5 | 0.0135 |
| 24.25 | 0.5 | 0.0135 |
| 24.251 | 0.515 | 0.013 |
| 25 | 0.515 | 0.013 |
| 25.5 | 0.515 | 0.013 |
| 25.501 | 0.53 | 0.013 |
| 26 | 0.53 | 0.013 |
| 26.75 | 0.53 | 0.013 |
| 26.751 | 0.545 | 0.0125 |
| 27 | 0.545 | 0.0125 |
| 28 | 0.545 | 0.0125 |
| 28.001 | 0.56 | 0.0125 |
| 29 | 0.56 | 0.0125 |
| 30 | 0.56 | 0.0125 |
| 30.001 | 0.575 | 0.012 |
| 31 | 0.575 | 0.012 |
| 32 | 0.575 | 0.012 |
| 32.001 | 0.59 | 0.012 |
| 33 | 0.59 | 0.012 |
| 34 | 0.59 | 0.012 |
| 34.001 | 0.6 | 0.012 |
| 35 | 0.6 | 0.012 |
| 36 | 0.6 | 0.012 |
| 37 | 0.6 | 0.012 |
| 38 | 0.6 | 0.012 |
| 39 | 0.6 | 0.012 |
| 39.5 | 0.6 | 0.012 |

expands to 0.014 inch at 32.001 inches from the outboard end 42 of the tip end section and remains at this thickness to the outboard end 36 of the butt end section 26. Thus, the smallest wall thickness of the shaft 22 is located in the central section 28 between the tip end section 24 and the butt end section 26. By comparison, the conventional shaft of Table II has a wall thickness at the outboard end of the tip end section of 0.023 inch. The wall thickness then decreases as the shaft extends toward the butt end section of the shaft with the smallest wall thickness of the shaft 0.012 inch being located in the butt end section including the outboard end thereof.

An analysis of the data in Tables I and II reveals that the wall thickness of the conventional shaft decreases from tip end of the shaft to the butt end with the smallest thickness located at the butt end while the wall thickness of the shaft 22 decreases from the tip end section 24 to the smallest thickness in the central section 28 at 0.0125 inch and then increases to the butt end section to 0.014 inch. This structure in the shaft 22 not only increases the wall thickness of the butt end section 26 in comparison to the conventional shaft, it also shifts the thinnest wall thickness to the central section 28.

With the increased wall thickness in the butt end section 26, the shaft 22 is more capable of withstanding the normal stresses to which the club and shaft are subjected during use of the club in playing the game of golf than the conventional shaft having a smaller wall thickness. Further, with the increased wall thickness, the moment per flexural rigidity at the butt end section 26 is lower in the shaft 22 than the thinner-walled conventional shaft of Table II thereby providing an improved flexure profile in the shaft 22. This results in a lower ball trajectory, approaching an optimum trajectory, which increases the distance the ball will travel when compared to the use of the conventional club. Also, the tip end section 24 of the shaft 22 is thicker than the tip end section of the conventional shaft of Table II whereby the weight of the tip end section 24 is heavier than of the conventional shaft. Effectively, with the heavier tip end section 24, the resultant torsion in the shaft 22 is lower than that of the conventional shaft which tends to keep the shaft in line when being swung and allows the golfer to "work" the shaft toward the ball for better accuracy.

Figure 7:
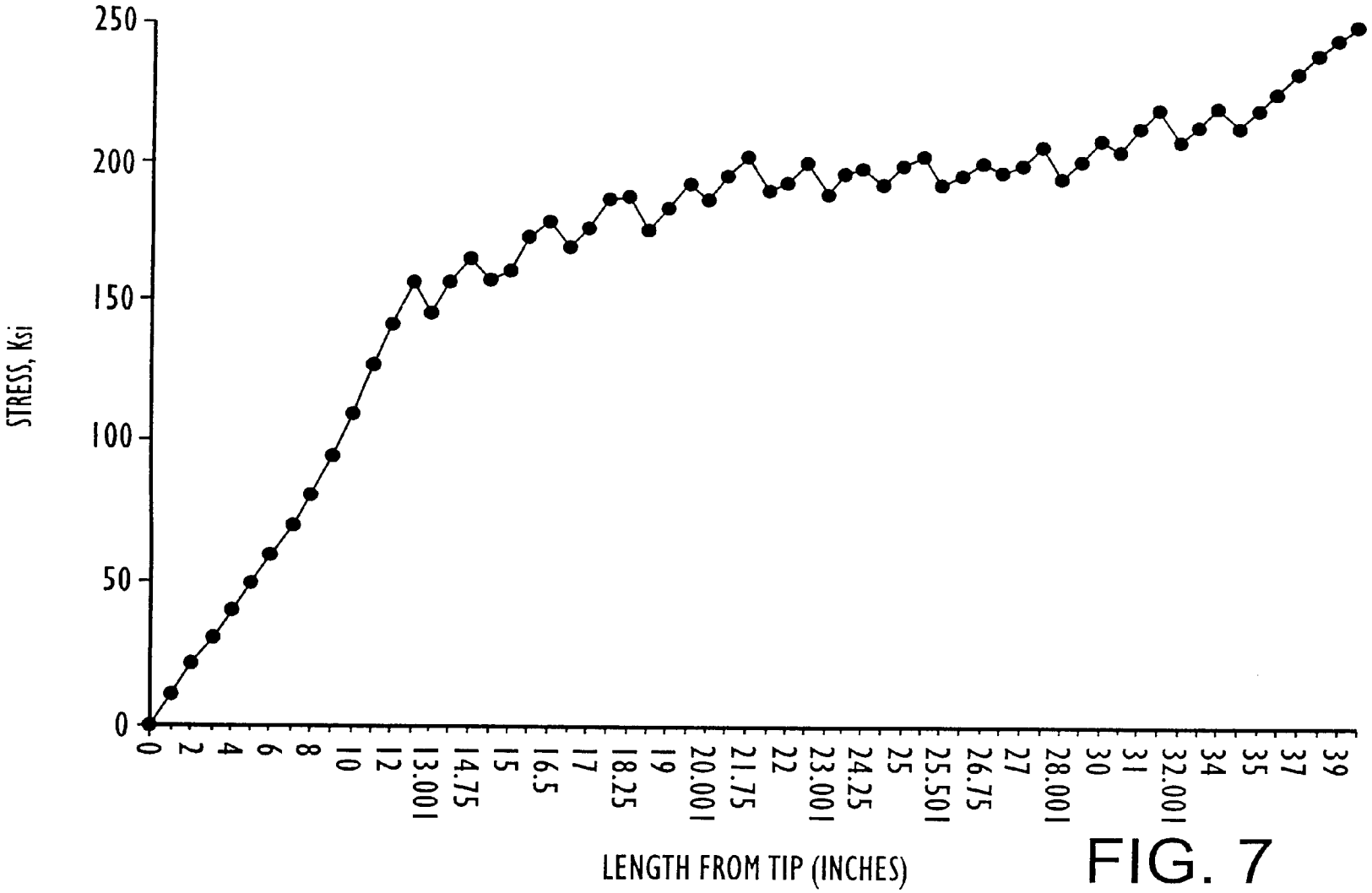
FIG. 7 is a graph illustrating the stresses occurring along the shaft of FIG. 2 in accordance with certain principles of the invention.
Figure 8:
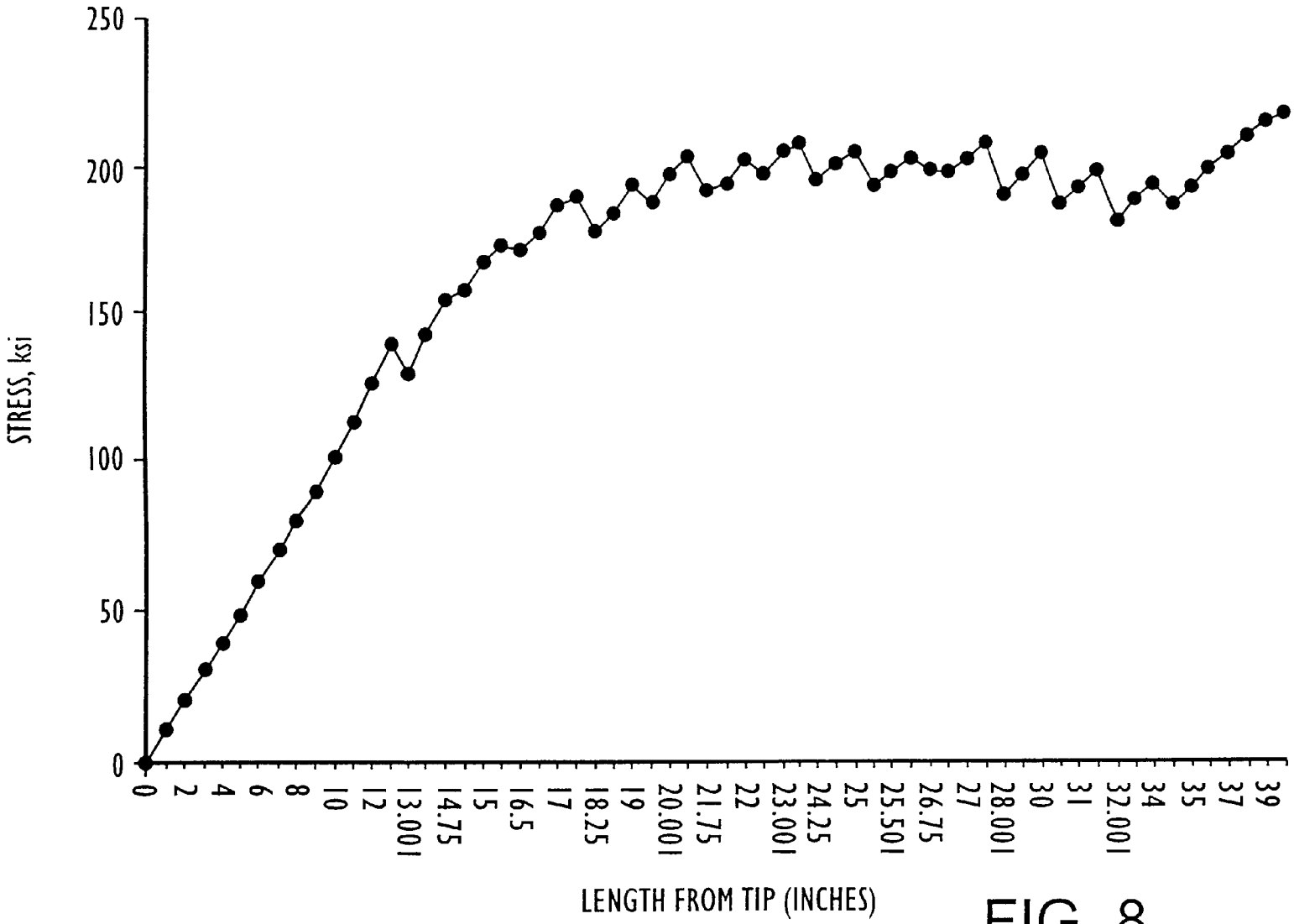
FIG. 8 is a graph illustrating the moments per flexural rigidity along a conventional steel shaft having stepped formations similar to the stepped formations of the shaft of FIG. 2.

In a comparison of the stress and moment per flexure rigidity analysis between the conventional shaft and the shaft 22, the butt end section 26 of the shaft 22 was clamped with the remainder of the shaft extending in cantilever therefrom. A weight of twenty pounds was placed at the outboard end 42 of the tip end section 24 whereby the shaft bent downward due to the weight. Measurements were the taken from the outboard end 42 of the tip end section 24 to precise distances or nodes along the shaft 22 as indicated along the abscissa of the graph of FIG. 8 and the stress at each location was determined and plotted to form the graph. An identical process was followed with respect to the conventional shaft which resulted in the graph shown in FIG. 7. A comparison of the two graphs reveals that the stress measured at the outboard end 36 of the butt end section 26 of the shaft 22 was approximately 215 Ksi while the stress at the comparable location on the conventional shaft was slightly under 250 Ksi. Also, the graphs reveal that the stress levels of the conventional shaft followed a general pattern of continued increase from the tip end section to the butt end section. In the shaft 22, the general pattern showed a slight decrease in stress levels at about 30 to 35 inches from the outboard end 42 of the tip end section 24 before beginning to rise to the level of 215 Ksi noted above.

Figure 9:
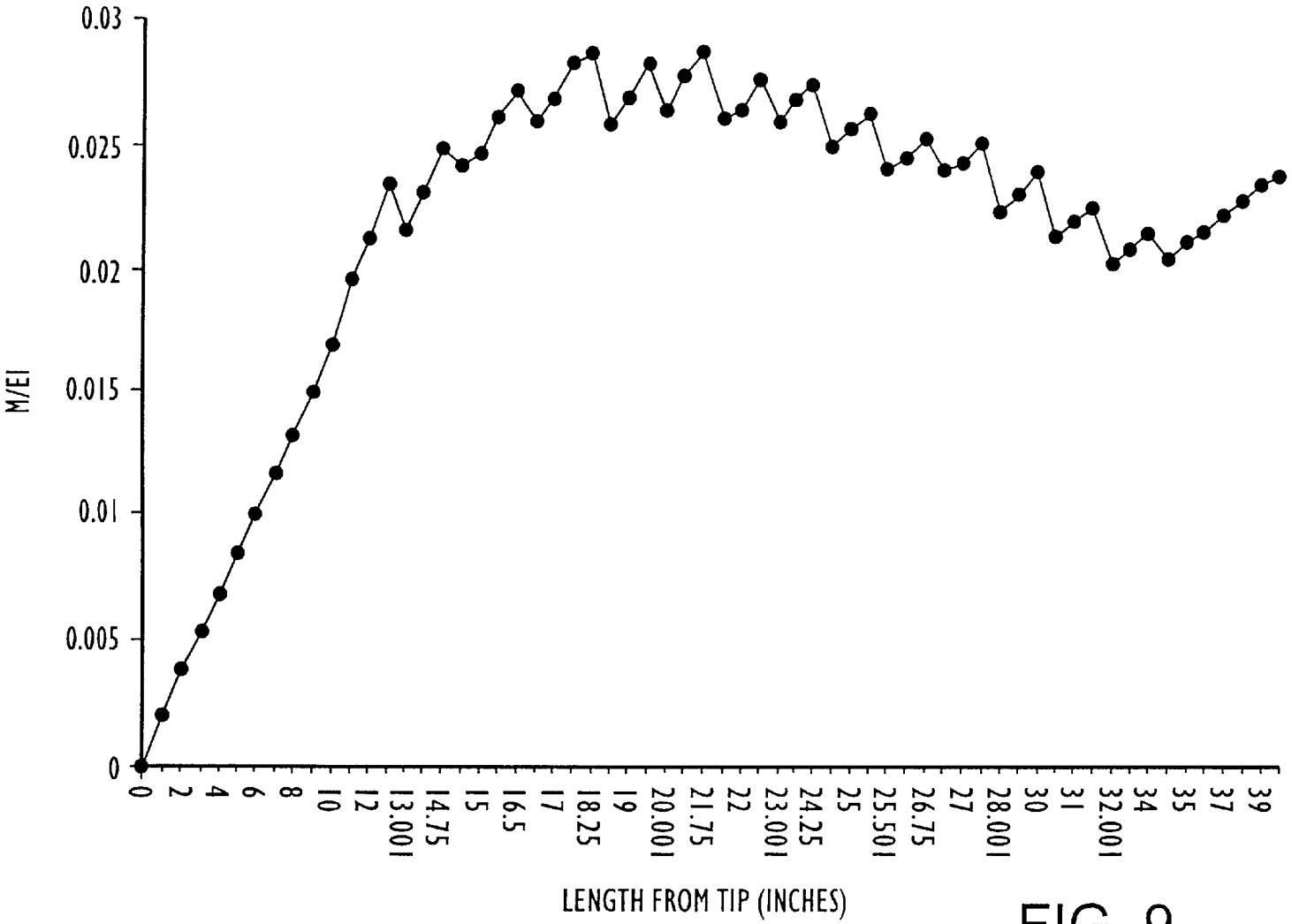
FIG. 9 is a graph illustrating the moments per flexural rigidity along the shaft of FIG. 2 in accordance with certain principles of the invention.
Figure 10:
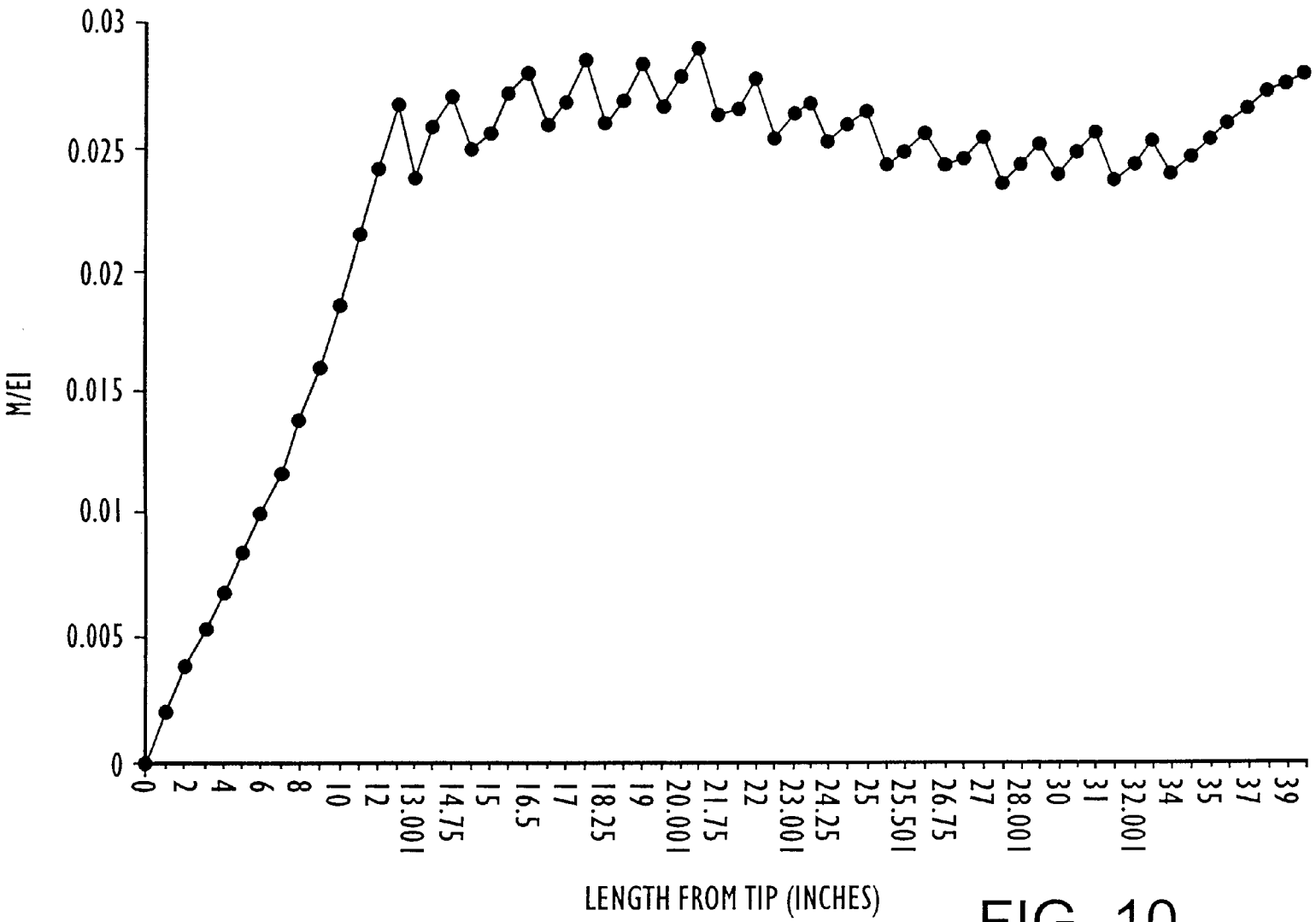
FIG. 10 is a graph illustrating the moments per flexural rigidity along a conventional shaft.

Graphs were also plotted with respect to the moment per flexural rigidity of the shaft 22 and the conventional shaft as shown in FIGS. 9 and 10, respectively. Again, the butt end section of each shaft was clamped and a twenty pound weight was placed on the outboard end of the tip end section. The moment of flexural rigidity, represented by the expression "M/EI" was calculated, where "M" represents the load-based moment at the particular node along the shaft, "E" represents the Modulus of Elasticity of steel and "I" represents the moment of inertia at the particular node along the shaft. "M" was determined by multiplying the 20 pounds times the distance from the weight (outboard end of the tip end section). "E" is a constant taken from a known table and "I" was determined by the equation:

$$I = \frac{\pi(D^4 - d^4)}{64}$$

where "D" is the outside diameter at the node where the measurement is to be calculated, and "d" is the inside diameter at the same node.

In comparison, the graph for the shaft 22 as shown in FIG. 9, reveals that the moment per flexural rigidity drops significantly to about 0.020 at about 32 to 34 inches and only rises again to about 0.024 at the outboard end 42 of the butt end section 24. In the conventional shaft, the moment per flexural rigidity at 32 to 34 inches is about 0.024 and increases to about 0.0275 at the outboard end of the tip end section of the conventional shaft. Also, an analysis of the two graphs of FIGS. 9 and 10 reveals that the flexure profile of the shaft 22 is an improvement over the flexure of the conventional shaft.

The graphs of FIGS. 7 through 10 support the advantages of the shaft 11 as noted above in comparison with the conventional shaft. When the club 20 is used, the higher stress levels appear at a lower location along shaft 22 than in the conventional shaft. Further, the moment per flexural rigidity is lower in the shaft 22 of club 20 than in the conventional shaft. This provides a lower trajectory of the ball when using the club 20 resulting in the ball travelling a farther distance in comparison with the travel of a ball when using the conventional shaft and club. Also, with the heavier tip end section 24, the club 20 exhibits a lower level of torsion when the club is swung and upon impact with the ball as compared with the conventional shaft and club.

As noted above, the description of the preferred embodiment related to a shaft with the parameters disclosed above and in the drawings. Shafts of other lengths and/or parameters could be manufactured in the same manner as described above and obtain the advantages of the preferred embodiment without departing from the spirit and scope of the invention.

In general, the above-identified embodiment is not to be construed as limiting the breadth of the present invention. Modifications, and other alternative constructions, will be apparent which are within the spirit and scope of the invention as defined in the appended claims.

What is claimed is:

1. A metal blank for a golf club shaft comprising:

a first end section having at least a portion thereof formed with a prescribed thickness and with an outboard end and an inboard end;

a second end section having at least a portion thereof formed with a second-section thickness and with an outboard end and an inboard end, said second-section thickness being different from said prescribed thickness;

a third section formed axially thereof between the inboard ends of the first end section and the second end section and having at least a portion thereof formed with a third-section thickness, said third-section thickness being less then both of said second-section thickness and said prescribed thickness; and said blank having an axis, a prescribed length between the outboard ends of the first end section and the second end section, and a uniform external diameter between the outboard ends of the first and second end sections.

2. The metal blank of claim 1 wherein said second-section thickness is less than the prescribed thickness.

3. The metal blank of claim 1 wherein said first end section has a uniform thickness equal to said prescribed thickness between said inboard and outboard ends thereof.

4. The metal blank of claim 3 wherein said second end section has a uniform thickness equal to said second-section thickness between said inboard and outboard ends thereof.

5. The metal blank of claim 4 wherein said third section further includes a small thickness section having said third-section thickness, a first transition section interconnecting the inboard end of said first section and the small thickness section, and a second transition section interconnecting the inboard end of the second section and the small thickness section.

6. The metal blank of claim 5 wherein said small thickness section has a uniform thickness equal to said third-section thickness.

7. The metal blank of claim 1 wherein said uniform external diameter is six tenths of an inch.

8. A blank for a golf club shaft comprising:

said blank being composed of metal and having an axis;

a first end section having an outboard end, an inboard end, and a prescribed thickness;

a second end section having an outboard end, an inboard end, and a second-section thickness less than the prescribed thickness;

a third section extending axially between the inboard ends of the first end section and the second end section and having a small thickness section having a small section thickness less than the second-section thickness; and said blank having a uniform external diameter between the outboard ends of the first end section and second end section.

9. The metal blank of claim 8 wherein said first end section has a uniform thickness equal to said prescribed thickness between said inboard and outboard ends thereof.

10. The metal blank of claim 9 wherein said second end section has a uniform thickness equal to said second-section thickness between said inboard and outboard ends thereof.

11. The metal blank of claim 10 wherein said third section further includes a first transition section interconnecting the inboard end of said first section and the small thickness section, and a second transition section interconnecting the inboard end of the second section and the small thickness section.

12. The metal blank of claim 11 wherein said small thickness section has a uniform thickness equal to said third-section thickness.

13. The metal blank of claim 8 wherein said uniform external diameter is six-tenths of an inch.

14. The blank of claim 8 being composed entirely of metal.

* * * * *